US006604334B2

(12) United States Patent
Rochman

(10) Patent No.: US 6,604,334 B2
(45) Date of Patent: Aug. 12, 2003

(54) CLAD FRAME SYSTEM AND METHOD

(75) Inventor: Oded E. Rochman, Thornhill (CA)

(73) Assignee: Rochman Universal Doors, Inc., Scarborough Ontario (CA)

( * ) Notice: Subject to any disclaimer, the term of this patent is extended or adjusted under 35 U.S.C. 154(b) by 0 days.

(21) Appl. No.: 09/983,302

(22) Filed: Oct. 24, 2001

(65) Prior Publication Data

US 2002/0046532 A1 Apr. 25, 2002

Related U.S. Application Data

(60) Provisional application No. 60/242,677, filed on Oct. 24, 2000.

(51) Int. Cl.[7] ..... E06B 1/04; E04C 2/38

(52) U.S. Cl. ..... 52/717.01; 52/211; 52/717.03; 52/717.06

(58) Field of Search ..... 52/211, 212, 717.01, 52/717.03, 717.05, 717.06; 49/504

(56) References Cited

U.S. PATENT DOCUMENTS

| | | | | |
|---|---|---|---|---|
| 654,607 A | | 7/1900 | Colborne | |
| 733,967 A | | 7/1903 | Hutchins et al. | |
| 1,535,777 A | | 4/1925 | Hoxie et al. | |
| 3,483,664 A | | 12/1969 | Funk et al. | |
| 3,815,285 A | * | 6/1974 | Kuyper | 49/501 |
| 4,078,288 A | | 3/1978 | Abramson | |
| 4,087,942 A | * | 5/1978 | Herrman | |
| 4,165,629 A | | 8/1979 | McCabe | |
| 4,235,089 A | | 11/1980 | Vecchi | |
| 4,295,299 A | * | 10/1981 | Nelson | |
| 4,341,048 A | * | 7/1982 | Minter | 49/504 |
| 4,981,058 A | | 1/1991 | Garrun, III | |
| 4,996,812 A | | 3/1991 | Venable | |
| 5,058,323 A | * | 10/1991 | Gerritsen | |
| 5,182,880 A | * | 2/1993 | Berge | |
| 5,203,130 A | * | 4/1993 | Freelove | |
| 5,284,043 A | | 2/1994 | Hayashi | |
| 5,377,519 A | | 1/1995 | Hayashi | |
| 5,669,192 A | * | 9/1997 | Opdyke | |
| 6,125,599 A | * | 10/2000 | Mees | |
| 6,125,605 A | * | 10/2000 | Young | |

FOREIGN PATENT DOCUMENTS

| | | |
|---|---|---|
| EP | 0716196 | 6/1996 |
| EP | 0 764707 | 3/1997 |
| WO | WO 00143608 | 7/2000 |

* cited by examiner

*Primary Examiner*—Carl D. Friedman
*Assistant Examiner*—Kevin McDermott
(74) *Attorney, Agent, or Firm*—Liniak, Berenato & White, LLC

(57) ABSTRACT

A cladded door frame system includes spaced left and right frame members orthogonally joined at upper portions thereof to a header, thus defining a door opening having exterior and interior sides. Each frame member includes a side jamb and a brickmold orthogonally extending along an exteriorly disposed surface of the side jamb. First, second and third metal cladding strips frictionally engage a respective frame member. Each cladding strip includes a U-shaped inner flange that engages three surfaces of one of the jambs and a U-shaped outer flange that engages three surfaces of one of the brickmolds. The inner flange is joined to the outer flange at an orthogonal orientation. The inner flange engages most of the surface area of the respective side jamb.

27 Claims, 2 Drawing Sheets

CLAD FRAME SYSTEM AND METHOD

CROSS REFERENCE TO RELATED APPLICATIONS

This application claims priority to Provisional U.S. Patent Application Serial No. 60/242,677, filed on Oct. 24, 2000.

FIELD OF THE INVENTION

The invention is directed to a clad frame system for doors, particular for exterior doors. Specifically, the invention is directed to a frame system having two side jambs, a header, two side brickmolds and a header brickmold, each of which is covered by a one-piece, galvanized steel, rolled cladding.

BACKGROUND

The selection of a suitable door frame for installation in an exterior door opening presents a wide variety of demands to the builder. It is important that door frames present a pleasing appearance without being cost prohibitive. They also need to have strength sufficient to hang a door. Another desirable property is a hardness sufficient to resist damage, such as by scuffing, denting or scratching. Many known door frames are unsuitable, because they fail to provide for all of these properties to the satisfaction of builders.

A typical door frame includes three members: two side jambs and one header extending between the jambs. Typically, a threshold is provided at the bottom of the frame. Many such door frames are made of wood. However, wood suffers from the disadvantage of succumbing to wood rot. Wood rot in door frames is known and is described in greater detail in U.S. Pat. No. 6,161,343. Generally speaking, when the moisture content rises above about 25% in wooden portions of the door frame, wood rot begins. The water is absorbed by the wood usually through an exposed end grain exposed to water. Once wood rot takes hold, the strength of the frame becomes markedly decreased, requiring removal of the rotten portions. Because replacement or repair due to wood rot is inevitable with wooden door frames, door frame manufacturers are unable to confidently guarantee customer satisfaction for an extended period of time for their door frames.

Often, wooden door frames are formed of high-grade lumber (wood planks having a relatively unflawed wood grain pattern on visible surfaces). While high-grade lumber presents an aesthetically pleasing appearance, it is often relatively expensive. One attempt to lower the overall cost involves the substitution of inferior grades of wood for the finished lumber. However, flaws found in inferior grades of wood, such as discontinuities in the surface, may not provide an appearance satisfactory to many homebuyers.

Wooden door frames also suffer from the disadvantage of not having a hardness sufficient to resist scuffing, scratching, denting, or the like. Attempt to solve this problem involve substitution of the wood with materials having a greater hardness. While these materials may have the requisite hardness, they often do not have a satisfactory combination of strength and relatively low cost.

Other attempts to solve the wood rot problem involve the use of several claddings that fit together to cover at least the front surface and side surface of each of the side jambs and the header. However, these cladding pieces require multiple molds, extrusion tools, or the like, in order to manufacture a full cladding set that will cover the desired surfaces of each of the door frame members. This approach also suffers from the disadvantage of being relatively complicated to assemble and install.

Thus, those skilled in the art will recognize that there is a need in the art for a door frame that need not be replaced due to wood rot, so that a door frame manufacturer may guarantee a buyer's satisfaction over an extended period of time. It is also apparent to those skilled in the art that there is a need for a door frame that offers more resistance to damage, such as by scuffing, scratching and denting, than is offered by wood door frames. It is likewise apparent to those skilled in the art that there is a need for such a door frame that is also relatively inexpensive.

BRIEF SUMMARY OF THE INVENTION

The inventor has discovered that these needs may be met by a door frame system that protects exterior surfaces of door frame members from the elements. The door frame system comprises first, second and third frame members and first, second and third elongate cladding strips. The first frame member includes a left side jamb and a left brickmold extending therealong. The second frame member includes a right side jamb and a right brickmold extending therealong. The third frame member includes a header and an upper brickmold extending therealong. The first and second frame members extend orthogonally from opposite ends of the third frame member to define a door opening having an exterior side. The first and second side jambs and the header each have a door stop jamb surface, a jamb surface facing toward the exterior side, and a jamb surface facing toward the door opening. Each of the brickmolds has a first brickmold surface facing toward the door opening, a second brickmold surface facing away from the door opening, and a third brickmold surface facing toward the exterior side. The first, second and third elongate cladding strips frictionally engage the first, second and third frame members, respectively. Each of the elongate cladding strips includes an inner flange connected to an outer flange. The inner flange engages one of the first and second side jambs and side header and includes a first leg, a second leg and a body portion from which the first and second inner flange legs extend. The first inner flange leg at least partly engages a respective one of the jamb surfaces facing the exterior side. The second inner flange leg engages most of a surface area of a respective one of the doorstop jamb surfaces. The body portion at least partly engages a respective one of the jamb surfaces facing the door opening. Each of said elongate cladding strips also includes an outer flange connected to the inner flange. The outer flange engages a respective one of the brickmolds and includes first and second legs and a decorative portion from which the first and second outer flange legs extend. The first outer flange leg engages a respective one of the first brickmold surfaces. The second outer flange leg engages a respective one of the second brickmold surfaces. The decorative portion engages a respective one of the third brickmold surfaces. Each of said elongate cladding strips is made of metal and is retained upon a respective one of the frame members.

Another embodiment of the invention is a one-piece cladding strip for extending along and protecting surfaces of one of first, second and third frame members defining a door opening. The first frame member has a first side jamb and a first brickmold extending along the first side jamb. The second frame member has a second side jamb and a second brickmold extending along the second side jamb. The third frame member has a header and a header brickmold extending along the header. Each of the side jambs and the header has a first frame surface facing an exterior side of the door opening, a second frame surface providing a door stop and facing an interior side of the door opening, and a third frame surface facing the door opening. Each of the brickmolds includes a first brickmold surface facing the door opening, a second brickmold surface facing away from the door opening, and a third brickmold surface facing the exterior side of the door opening. The one-piece cladding strip comprises inner and outer flanges. The inner flange has a first leg at least partly engaging the first frame surface, a second leg engaging most of a surface area of the second frame surface, and a body portion at least partly engaging the third frame surface. The first inner flange leg is orthogonally joined to the body portion. The body portion is orthogonally joined to the second inner flange leg. The first and second inner flange legs are oriented parallel to one another. The outer flange has a first leg engaging the first brickmold surface, a second leg engaging the second brickmold surface and a decorative portion engaging the third brickmold surface. The first outer flange leg is orthogonally joined to the decorative portion. The decorative portion is orthogonally joined to the second outer flange leg. The first and second outer flange legs are oriented parallel to one another. The first inner flange leg is joined orthogonally to said first outer flange leg. The cladding strip is elastically deformable such that said cladding strip may be snapped into position upon one of the frame members for frictional engagement therewith, and is made of metal.

DETAILED DESCRIPTION OF THE INVENTION

Figures 1, 3:
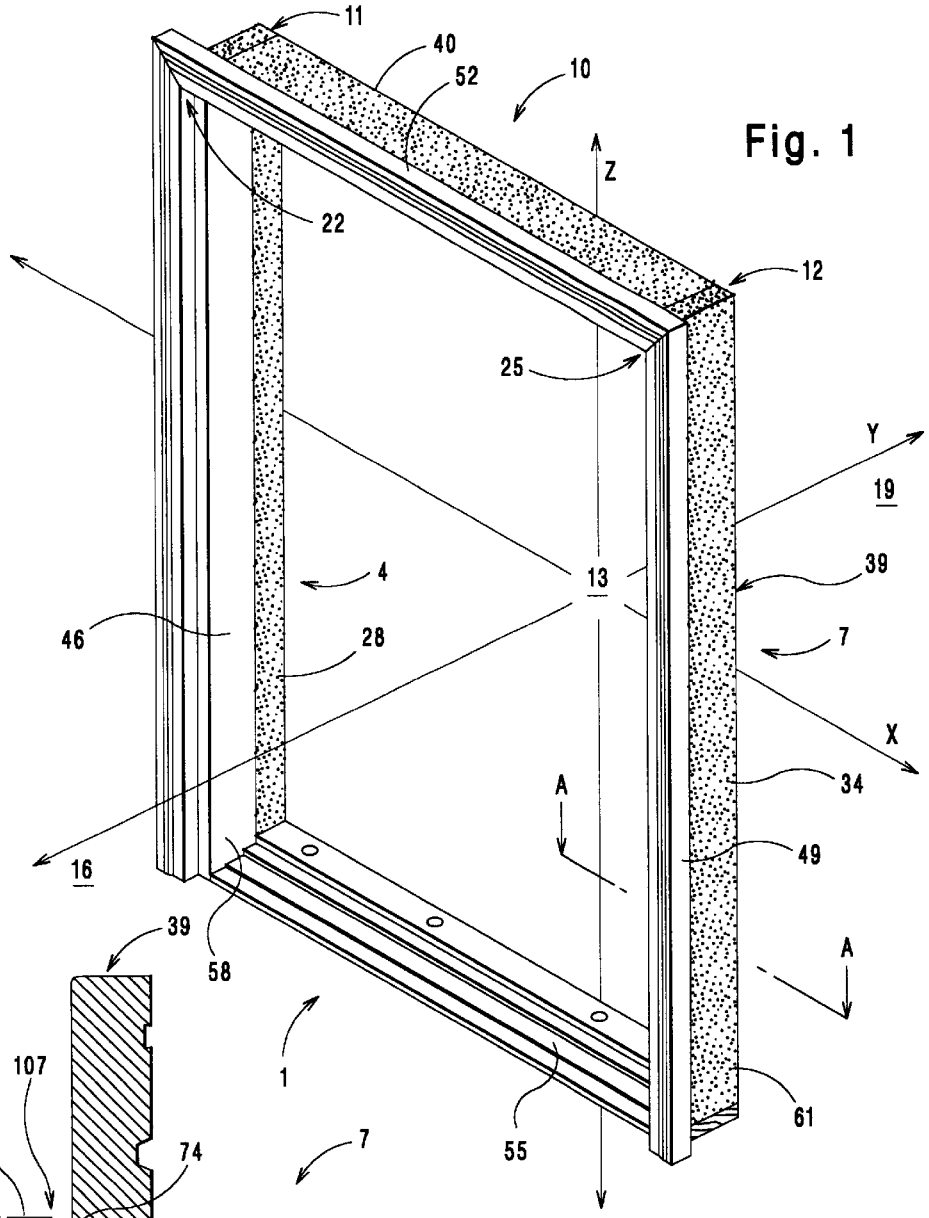
FIG. 1 is a perspective view of the clad frame system of the invention.
FIG. 3 is a cross-sectional view of FIG. 1 taken along the line A—A and further includes a fragmentary portion of a wall.
Figure 2:
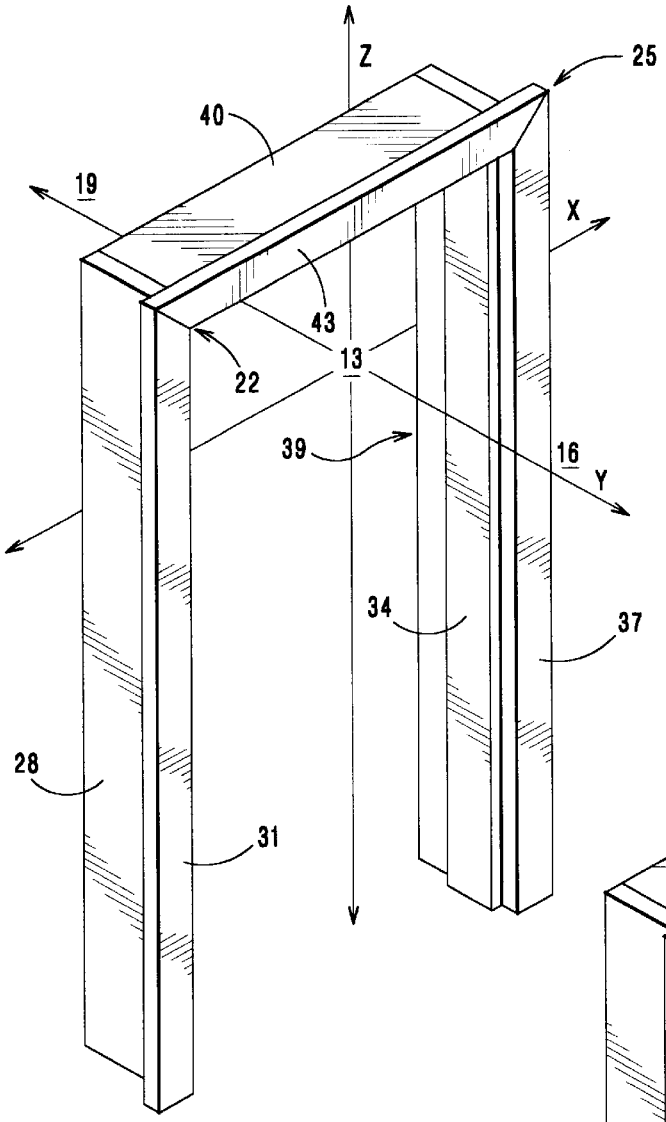
FIG. 2 is a perspective view of first, second and third frame members of the clad frame system with the cladding strips removed.

As illustrated in FIGS. 1, 2 and 3, the clad frame system 1 of the present invention includes first and second upright frame members 4, 7 that are spaced and parallel to each other. The frame system also includes a header frame member 10 extending between topmost portions 11, 12 of the upright frame members 4, 7. It may be noted that each of the frame members 4, 7, 10 is elongate. Together, the upright frame members 4, 7 and header frame member 10 define a door opening 13. With reference to axes x, y and z, the door opening 13 separates an exterior side 16 (in foreground) of opening 13 from an interior side 19 (background) of opening 13. Preferably, the frame system 1 is used for framing a door on the exterior of a building. Thus, exterior side 16 is disposed outside the building. Consequently, interior side 19 is disposed inside the building.

As best illustrated in FIGS. 2 and 3, each of the frame members 4, 7, 10 preferably includes at least two subcomponents: a jamb and a brickmold. Thus, the first upright frame member 4 includes a left side jamb 28 and a left brickmold 31 extending therealong. The second upright frame member 7 correspondingly includes a right side jamb 34 and a right brickmold 37 extending therealong. Right side jamb 34 is adjacent a masonry wall 38 and a portion of right side jamb 34 projects inward (toward the interior of the door opening 13) from wall 38 and extends to a back surface 39. Similar to the left and right side jambs 28, 34 and left and right brickmolds 31, 37, an upper brickmold 43 extends along a header jamb 40. Together, upper brickmold 43 and header jamb 40 comprise the header frame member 10. In each case, brickmolds 31, 37, 43 extend along a surface of the jambs 28, 34, and 40 that faces exterior side 16. Preferably, the brickmolds 31, 37, 43 cover most of an area of this surface. The term "most" as used herein is defined as 50% or greater. As shown in FIG. 2, brickmolds 31 and 43 meet at a 45° mitered joint 22, whereas brickmolds 37 and 43 meet at a 45° mitered joint 25. It is understood that other angles for the mitered joint 25 may be used.

As best illustrated in FIGS. 1 and 3, the frame system 1 also includes first, second and third cladding strips 46, 49, 52 at least partially covering each of frame members 4, 7, 10, respectively. Similar to frame members 4, 7, 10, cladding strips 46, 49, 52 are elongate and meet at 45° mitered joints 22, 25. Although not essential to the invention, the frame system 1 may also include a threshold 55 extending between bottom most portions 58, 61 of first and second frame members 4, 7.

FIG. 3 illustrates a cross-section of the second upright frame member 7 (including right side jamb 34 and right brickmold 37) and second cladding strip 49. While similar cross-sections of the first upright frame member 4 and upper frame member 10 are not depicted, it is understood that they (and the corresponding jambs 28, 40 and brickmolds 31, 43) have the same configuration in cross-section. As seen in FIG. 3, second cladding strip 49 frictionally engages second upright frame member 7. Second cladding strip 49 includes an inner flange 60 and an outer flange 80, each of which is generally U-shaped in cross-section. While inner flange 60 extends along and at least partially overlies some of right side jamb 34, outer flange 80 extends along and at least partially overlies some of right brickmold 37.

Inner flange 60 has first and second legs 62, 64 that are spaced apart from each other. Preferably, first and second legs 62, 64 are generally parallel to one another. Inner flange 60 also has a body portion 66 that connects to, and extends between, legs 62, 64 at edges 63, 65, respectively. Preferably, body portion 66 is oriented about 90° relative to legs 62, 64. First leg 62 extends along right side jamb 34 adjacent the portion of a surface 68 that faces toward exterior side 16 but which is not covered by right brickmold 37. Body portion 66 extends along right side jamb 34 adjacent the portion of a surface 72 that faces the door opening 13. Second leg 64 extends along right side jamb 34 adjacent doorstop jamb surface 70.

Although not essential to the invention, weather stripping may be used to provide a barrier to the elements in between the door on one hand and the doorstop jamb surface 70 and second leg 64 on the other hand. If so, the weather stripping should be disposed at least partially within kerf 74 and project inwardly towards interior side 19. The weather stripping should also project along doorstop jamb surface 70 towards door opening 13 up to second leg 64. That way, the doorstop jamb surface 70 is substantially protected from exposure to the elements.

Preferably, second leg 64 extends along most of doorstop jamb surface 70. That way, a relatively wide variety of configurations of weather stripping may be utilized. On the other hand, if second leg 64 did not extend along most of door stop jamb surface 70, the weather stripping would need to be especially configured to project toward door opening 13 along door stop jamb surface 70 up to second leg 64. Otherwise, doorstop jamb surface 70 would remain unprotected from the elements. When the length of second leg 64 is selected such that it extends along most of doorstop jamb surface 70, the weather stripping need not be especially configured to have such a projection. A second leg 64 that extends along most of doorstop jamb surface 70 provides an additional advantage. Such a longer second leg 64 grips second upright frame member 7 with greater frictional engagement than compared to a shorter second leg 64.

Outer flange 80 has first and second legs 82, 84 that are spaced apart from each other. Preferably, first and second legs 82, 84 are generally parallel one another. Outer flange 80 also has a decorative portion 86 that connects to, and extends between, legs 82, 84 at edges 83, 85, respectively. Preferably, decorative portion 86 is generally oriented about 90° relative to legs 82, 84.

First leg 82 extends along right side brickmold 37 adjacent the portion of a surface 88 that faces the door opening 13 but which is not covered by right brickmold 37. Second leg 84 extends along right brickmold 37 adjacent the portion of a surface 90 that faces away from the door opening 13. Preferably, second leg 84 completely covers surface 90. While FIG. 3 depicts an end 91 of second leg 84 as abutting masonry wall 38, it is understood that other lengths of second leg 84 may be selected that may not abut wall 38. Similarly, it is understood that clad frame system 1 may be used with thicker or thinner walls 38.

Decorative portion 86 extends along right brickmold 37 adjacent the surface 92 that faces toward exterior side 16. While decorative portion 86 is illustrated as having two stepped segments 87, it is understood that any other configuration may be utilized. For example, decorative portion 86 may be configured to simulate decoratively carved brickmolds used with door frames. Preferably a decorative pattern, such as a wood grain pattern, is rolled into the decorative portion 86.

The lengths of first and second legs 82, 84 and decorative portion 86 may be widely varied to provide whatever appearance is desired and/or to suit the particular dimensions of right side jamb 34 and right brickmold 37. For example, while first and second legs 82, 84 of outer flange 80 are depicted as extending forwardly beyond edges 94, 96, leaving a gap 98, the lengths of first and second legs 82, 84 may be shortened to allow a snug engagement between decorative portion 86 and surface 92. Similarly, the lengths of legs 82, 84 may be modified to allow any other size gap 98 or to allow another decorative pattern instead of stepped segments 87. Preferably, a support 99 is secured to brickmold 37, as best shown in FIG. 3. Support 99 is positioned at the edge of brickmold 37 along edge 96 and extends the length thereof. Support 99 may be formed of wood or a wood composite and may be adhesively secured to brickmold 37, such as with polyvinyl acetate. Alternatively, support 99 may be formed integral with brickmold 37. The support 99 fills the gap 98, and thereby resists crushing or deformation of decorative portion 86.

It is understood that the configurations of the first, second and third cladding strips 46, 49, 52 are identical, except for their lengths (third cladding strip 52 is shorter than the first and second cladding strips 46, 49 in a typical doorway that is taller than it is wide). Consequently, cross-sections of the left side jamb 28, left brickmold 31, header jamb 40, upper brickmold 43, and first and third cladding strips 46, 52 are identical to those of the right side jamb 31, right brickmold 34 and second cladding strip 49, respectively.

The inventor has also discovered that the wood rot problem may be avoided if the proper material is selected for the cladding strips 46, 49, 52. For example, when the cladding strips 46, 49, 52 are made of a relatively rigid material, the cladding strips 46, 49, 52 provide the strength sufficient to hold the inventive frame system up even if wood rot degrades the structural integrity of frame members 4, 7, 10 when they are made of wood. Preferably, the material for the cladding strips 46, 49, 52 is steel, more preferably hot dip galvanized steel, even more preferably hot dip galvanized 26 GA sheet steel. Preferably, the cladding strips 46, 49, 52 are also at least somewhat elastically deformable such that they may be snapped into place on the frame members 4, 7, 10 for frictional engagement therewith. The cladding strips 46, 49, 52 may also be provided with a protective layer on exteriorly disposed surfaces, i.e., those that are exposed to the elements. Such a protective layer includes paint.

The cladding strips 46, 49, 52 are preferably roll formed, i.e., one piece of cladding stock material is rolled between rollers to achieve the desired configuration of cladding strips 46, 49, 52. When such a method is employed, a one-piece cladding is thus produced from a one-piece stock material, i.e., so-called unitarily forming. Roll forming may be contrasted with other methods of producing cladding, such as joining two or more components to achieve the final configuration of the cladding. Such other methods do not result in a unitarily formed one-piece cladding.

The jambs 28, 34, 40 and brickmolds 31, 37, 43 may be made of wood. Because a cladding conceals portions of the jambs 28, 34, 40 and brickmolds 31, 37, 43, a relatively inferior grade of wood is preferred from a cost standpoint. The threshold 55 may be made of any material known in the art for such a use.

The clad frame system 1 may be assembled as follows. One end of each of the right and left brickmolds 31, 37 and first and second cladding strips 46, 49 are cut at a 45° angle for later forming of mitered joints 22, 25 with the upper brickmold 43 and third cladding strip 52, respectively. Thus, each of the ends of the upper brickmold 43 and third cladding strip 52 is also cut at a 45° angle, thus completing the configuration necessary for the mitered joints 22, 25. Next, the side jambs 28, 34 are parallel spaced and the header jamb 40 is laid at a right angle extending between the jambs 28, 34 and one end thereof. The threshold, if desired, is similarly laid between the opposite ends of the side jambs 28, 34. The jambs 28, 34, 40 and threshold 55 are then nailed together at each of the four corners. The right, left and upper brickmolds 31, 37, 43 are then placed along surface 68 at a 90° angle relative the surface of the jambs 28, 34, 40 facing the exterior side 16 and placed against one another such that the cut corners form mitered joints 22, 25. Thus placed, brickmolds 31, 37, 43 are then nailed or otherwise secured to the jambs 28, 34, and 40 with brad nails.

The second cladding strip is then put in place as follows. The end 91 of the second leg 84 is placed rearward of edge 104 of right brickmold 37. The cladding strip 49 is then pivoted around the right brickmold 37 and right side jamb 34 so that end 107 of the inner flange 60 is snapped into place over edge 110 of the right side jamb 34 and second leg 64 extends along door stop jamb surface 70 for frictional engagement therewith. Thus, cladding strip 49 is frictionally retained upon second frame member 7. This method of installing the cladding is repeated for the first and third cladding strips 46, 52 along the first and third frame members 4, 7, respectively, so that the first and third, and the second and third, cladding strips 46, 49, 52 meet at mitered joints 22, 25, respectively.

Figure 4:
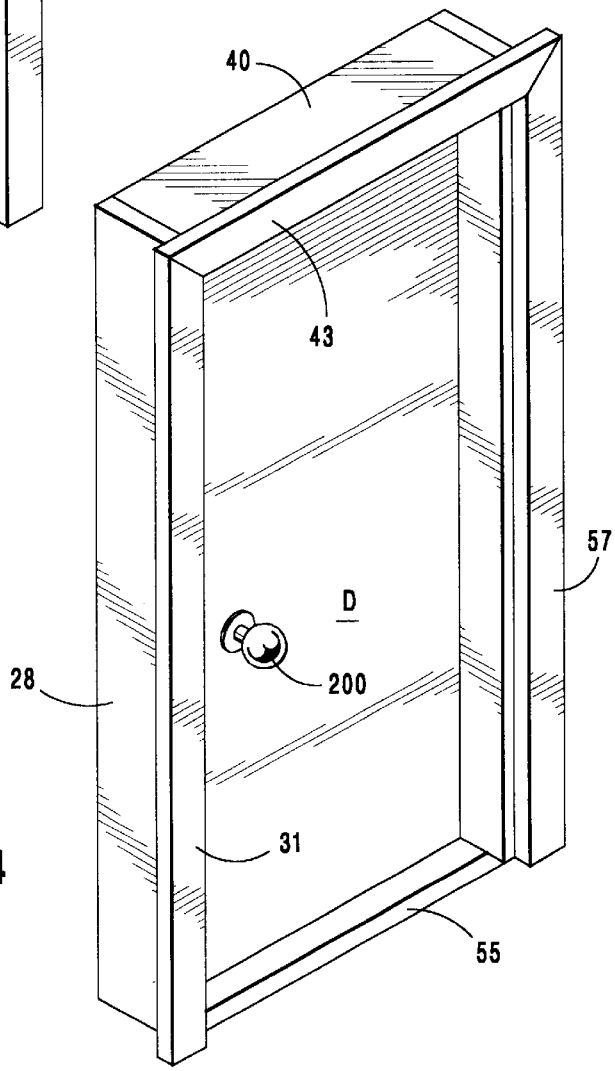
FIG. 4 is a perspective view of the clad frame system of the invention in combination with a steel entry door.

As best shown in FIG. 4, a steel entry door D is supported by interior hinges (not shown) in well-known manner.

Doorknob 200 or similar access member is provided to permit door D to be opened. Preferably, threshold 55 is disposed below door D. The door D and cladding strips are preferably manufactured from identical gauge galvanized steel. Because the cladding strips 46, 49, and 52 are manufactured from the same material as is used to manufacture the door D, then paint color and texture differences are eliminated. The door D and the cladding strips 46, 49, and 52 thus possess identical texture and gloss, presenting a more aesthetically pleasing appearance to the consumer. In the past, because the door was made from steel and the frame from wood, then those members would exhibit differences in both paint texture and gloss, sometimes to a marked extent.

Having thus described the invention, it will be realized that although the foregoing description of the inventor's preferred embodiment includes specific quantities, materials, dimensions and procedures, modifications and variations thereof might be employed without departing from the inventive concept herein.

I claim:

1. A cladded door frame system for protecting exterior surfaces of door frame members from the elements; said system comprising:

a) a first frame member including a left side jamb and a left brickmold extending therealong;

b) a second frame member including a right side jamb and a right brickmold extending therealong;

c) a third frame member including a header and an upper brickmold extending therealong, said first and second frame members extending orthogonally from opposite ends of said third frame member to define a door opening having an exterior side, said first and second side jambs and said header each having a door stop jamb surface, a jamb surface facing toward said exterior side, and a jamb surface facing toward said door opening, said brickmolds each having a first brickmold surface facing toward said door opening, a second brickmold surface facing away from said door opening, and a third brickmold surface facing toward said exterior side;

d) a first elongate cladding strip frictionally engaging said first frame member;

e) a second elongate cladding strip frictionally engaging said second frame member; and f) a third elongate cladding strip frictionally engaging said third frame member; wherein i) each of said elongate cladding strips includes an inner flange engaging a respective one of said first and second side jambs and said header, said inner flange including a first leg, a second leg and a body portion from which said first and second inner flange legs extend, said first inner flange leg at least partly engaging a respective one of said jamb surfaces facing said exterior side, said second inner flange leg engaging most of a surface area of a respective one of said door stop jamb surfaces, said body portion at least partly engaging a respective one of said jamb surfaces facing said door opening, ii) each of said elongate cladding strips also includes an outer flange connected to said inner flange, said outer flange engaging a respective one of said brickmolds, said outer flange including first and second legs and a decorative portion from which said first and second outer flange legs extend, said first outer flange leg engaging a respective one of said first brickmold surfaces, said second outer flange leg engaging a respective one of said second brickmold surfaces, said decorative portion spaced from a respective one of said third brickmold surfaces to define a gap, iii) each of said elongate cladding strips is made of metal, and iv) each of said elongate cladding strips is retained upon a respective one of the frame members.

2. The cladded door frame system of claim 1, wherein:

a) each of said first and second inner flange legs orthogonally extends from said body portion; and b) each of said first and second outer flange legs orthogonally extends from said decorative portion.

3. The cladded door frame system of claim 2, wherein:

a) said first inner flange leg orthogonally extends from said first outer flange leg.

4. The cladded door frame system of claim 1, wherein:

a) said second inner flange leg engages no less than 50% of the surface area of the respective one of said doorstop jamb surfaces.

5. The cladded door frame system of claim 1, further comprising:

a) a kerf formed in each of said doorstop jamb surfaces for retaining a weather stripping.

6. The cladded door frame system of claim 1, wherein:

a) said cladding strips are made of steel.

7. The cladded door frame system of claim 6, wherein:

a) said cladding strips are made of galvanized steel.

8. The cladded door frame system of claim 7, further comprising:

a) a protective coating on each cladding strip.

9. The cladded door frame system of claim 8, further comprising:

a) a decorative pattern formed in each of said decorative portions.

10. The cladded door frame system of claim 1, wherein:

a) each one of said brickmolds extends along a respective one of said jamb surfaces facing toward said exterior side.

11. The cladded door frame system of claim 10, wherein:

a) each one of said brickmolds is orthogonally oriented with a respective one of said jambs.

12. The cladded door frame system of claim 11, wherein:

a) each of said brickmolds extends over most of a surface of said respective one of said jamb surfaces facing toward said exterior side.

13. The cladded door frame system of claim 1, wherein:

a) each one of said second outer flange legs entirely covers a respective one of said second brickmold surfaces.

14. The cladded door frame system of claim 1, wherein:

a) each one of said cladding strips is elastically deformable such that said cladding strip is snapped into position upon a respective one of said frame members for frictional engagement therewith.

15. A one-piece cladding strip for extending along and protecting surfaces of one of first, second and third frame members defining a door opening, the first frame member having a first side jamb and a first brickmold extending along the first side jamb, the second frame member having a second side jamb and a second brickmold extending along the second side jamb, the third frame member having a header and a header brickmold extending along the header, each of the side jambs and the header having a first frame surface facing an exterior side of the door opening, a second frame surface providing a door stop and facing an interior side of the door opening, and a third frame surface facing the door opening, each of the brickmolds including a first brickmold surface facing the door opening, a second brickmold surface facing away from the door opening, and a third brickmold surface facing the exterior side of the door opening, said one-piece cladding strip comprising:

a) an inner flange having a first leg at least partly engaging the first frame surfaces, a second leg engaging most of a surface area of the second frame surface, and a body portion at least partly engaging the third frame surface, said first inner flange leg being orthogonally joined to said body portion, said body portion being orthogonally joined to said second inner flange leg, said first and second inner flange legs being oriented parallel to one another; and b) an outer flange having a first leg engaging the first brickmold surface, a second leg engaging the second brickmold surface and a decorative portion spaced from the third brickmold surface to define a gap, said first outer flange leg being orthogonally joined to said decorative portion, said decorative portion being orthogonally joined to said second outer flange leg, said first and second outer flange legs being oriented parallel to one another; wherein i) said first inner flange leg is joined orthogonally to said first outer flange leg, ii) said cladding strip being elastically deformable such that said cladding strip is snapped into position upon one of the frame members for frictional engagement therewith, and ii) said cladding strip is made of metal.

16. The elongate cladding strip of claim 15, wherein:

a) said second inner flange leg engages no less than 50% of the surface area of the respective one of said second frame surfaces.

17. The elongate cladding strip of claim 16, wherein:

a) said cladding strip is made of steel.

18. The elongate cladding strip of claim 17, wherein:

a) said cladding strip is made of hot dip galvanized steel.

19. The elongate cladding strip of claim 18, further comprising:

a) a coat of paint on all exteriorly disposed surfaces of each cladding strip.

20. The elongate cladding strip of claim 19, further comprising:

a) a decorative pattern rolled into each of said decorative portions.

21. The elongate cladding strip of claim 15, wherein:

a) said inner and outer flanges are roll formed.

22. An elongate cladding strip for protecting surfaces of one of first, second and third frame members defining a door opening, the first frame member including a first side jamb and a first brickmold extending along therewith, the second frame member including a second side jamb and a second brickmold extending along therewith, the third frame member including a header and a header brickmold extending along therewith, each one of the brickmolds being oriented orthogonally to a respective one of the side jambs and header along a surface thereof that faces toward an exterior side of the door opening, said elongate cladding strip comprising:

a) an inner flange engageable with a respective one of the side jambs and the header, said inner flange having first and second legs connected to opposite ends of a body portion, said first inner flange leg engageable with a surface of the respective one of the side jambs and the header that faces an exterior side of the door opening, said second inner flange leg engageable with most of a surface area of a door stop surface of the respective one of the side jambs and the header, said body portion engageable with a surface of the respective one of the side jambs and the header that faces a door opening; and b) an outer flange engaging a respective one of the brickmolds, said outer flange having first and second legs connected to opposite ends of a decorative portion, said first outer flange leg engageable with a surface of the respective one of the brickmolds that faces toward the door opening, said second outer flange leg engageable with a surface of the respective one of the brickmolds that faces away from the door opening, said decorative portion spaced from a surface of the respective one of the brickmolds that faces towards an exterior side of the door opening to define a gap; wherein:

i) said elongate cladding strip being elastically deformable such that said elongate cladding strip is snapped into position upon one of the frame members for frictional engagement therewith, and ii) said elongate cladding strip is made of metal.

23. A method of installing a cladding strip on a door frame having first, second and third frame members defining a door opening, the first frame member including a first side jamb and a first brickmold extending along therewith, the second frame member including a second side jamb and a second brickmold extending along therewith, the third frame member including a header and a header brickmold extending along therewith, each one of the brickmolds being oriented orthogonally to a respective one of the side jambs and header along a surface thereof that faces toward an exterior side of the door opening, each of the side jambs and the header having a door stop surface that faces toward an interior side of the door opening and that abuts against a door mounted in the door opening, each of the brickmolds having a surface facing away from the door opening, said method comprising:

a) providing an elongate metal cladding strip that includes i) an inner flange engageable with a respective one of the side jambs and the header, the inner flange having first and second legs connected to opposite ends of a body portion, the first inner flange leg engageable with a surface of the respective one of the side jambs and the header that faces an exterior side of the door opening, the second inner flange leg engageable with a door stop surface of the respective one of the side jambs and the header, the second inner flange leg having a joint end connected to the body portion and a free end not connected to the body portion, the body portion engageable with a surface of the respective one of the side jambs and the header that faces a door opening, and ii) an outer flange engaging a respective one of the brickmolds, the outer flange having first and second legs connected to opposite ends of a decorative portion, the second outer flange leg having a joint end connected to the decorative portion and a free end not connected to the decorative portion, the first outer flange leg engageable with a surface of the respective one of the brickmolds that faces toward the door opening, the second outer flange leg engageable with a surface of the respective one of the brickmolds that faces away from the door opening, the decorative portion spaced from a surface of the respective one of the brickmolds that faces towards an exterior side of the door opening;

b) placing an end of the second outer flange leg along the respective one of the brickmolds adjacent the surface that faces away from the door opening; and c) pivoting the elongate cladding strip around the respective one of the frame members such that the free end of the second inner flange leg is placed along the door stop jamb surface of the respective one of the side jambs and the header, wherein the elongate cladding strip becomes frictionally engaged with the respective one of the frame members and the second inner flange leg extends along most of a surface area of a door stop surface of the respective one of the side jambs and the header.

24. The cladded door frame system of claim 6, further comprising:

a) a steel door hingedly secured to one of said frame members and pivotal relative thereto, said door formed from steel.

25. The cladded door frame system of claim 24, wherein:

a) said door and said cladding, strips having a common coating applied thereto, so that said door and said cladding strips exhibit uniform texture and gloss.

26. The cladded frame system of claim 1, further comprising:

a) a support extending along each of said frame members and disposed within the gap defined by the associated frame member and cladding strip.

27. The cladded frame system of claim 26, wherein:

a) each support is formed of wood and is secured to the associated frame member.

* * * * *